US006460798B1

(12) United States Patent
Haen et al.

(10) Patent No.: US 6,460,798 B1
(45) Date of Patent: Oct. 8, 2002

(54) DISPENSER APPARATUS WITH TRANSFER MECHANISM

(75) Inventors: William G. Haen, DePere; Daniel C. Kananen; Alan P. Paal, both of New Franken; Alan J. Pierquet, Green Bay, all of WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 0 days.

(21) Appl. No.: 09/685,501

(22) Filed: Oct. 10, 2000

(51) Int. Cl.[7] ..... B65H 19/00
(52) U.S. Cl. ..... 242/560; 242/564.4
(58) Field of Search ..... 242/559, 560, 242/550, 551, 562.1, 563, 564.4; 226/11

(56) References Cited

U.S. PATENT DOCUMENTS

| | | | | |
|---|---|---|---|---|
| 2,248,193 | A | 7/1941 | Price et al. | 271/2.3 |
| 2,307,994 | A | 1/1943 | Clemens | 242/55.3 |
| 2,839,346 | A | 6/1958 | Lawalin | 312/39 |
| 2,919,842 | A | 1/1960 | Batlas | 225/12 |
| 2,957,738 | A | 10/1960 | Marcuse | 312/39 |
| 2,974,839 | A | 3/1961 | Batlas et al. | 225/12 |
| 3,281,032 | A | 10/1966 | Solomon | 225/16 |
| 3,317,099 | A | 5/1967 | Solomon | 225/23 |
| 3,628,743 | A | 12/1971 | Bastian et al. | 242/55.3 |
| 4,010,909 | A | 3/1977 | Bastian | 242/55.3 |
| 4,067,509 | A | 1/1978 | Grahm et al. | 242/55.3 |
| 4,106,684 | A | 8/1978 | Hartbauer et al. | 226/91 |
| 4,137,805 | A | 2/1979 | DeLuca et al. | 83/345 |
| 4,165,138 | A | 8/1979 | Hedge et al. | 312/39 |
| 4,203,562 | A | 5/1980 | DeLuca et al. | 242/55.3 |
| 4,307,638 | A | 12/1981 | DeLuca et al. | 83/37 |
| 4,307,639 | A | 12/1981 | DeLuca | 83/337 |
| 4,317,547 | A | 3/1982 | Grahm et al. | 242/55.3 |
| 4,358,169 | A | 11/1982 | Filipowicz | 312/39 |
| 4,378,912 | A | 4/1983 | Perrin et al. | 242/55.3 |
| 4,396,163 | A | 8/1983 | Grahm et al. | 242/55.3 |
| 4,403,748 | A | 9/1983 | Cornell | 242/55.53 |
| 4,432,261 | A | 2/1984 | DeLuca | 83/37 |
| 4,487,375 | A | 12/1984 | Rasmussen et al. | 242/55.3 |
| 4,611,768 | A | 9/1986 | Voss et al. | 242/55.3 |
| 4,635,837 | A | 1/1987 | Granger | 225/96 |
| 4,666,099 | A | 5/1987 | Hoffman et al. | 242/55.53 |
| 4,756,485 | A | 7/1988 | Bastian et al. | 242/55.3 |
| 4,786,005 | A | 11/1988 | Hoffman et al. | 242/55.53 |
| 4,807,824 | A | 2/1989 | Gains et al. | 242/55.3 |
| 4,846,412 | A | 7/1989 | Morand | 242/55.3 |
| 4,856,724 | A | 8/1989 | Jespersen | 242/55.3 |
| 4,944,466 | A | 7/1990 | Jespersen | 242/55.3 |
| 5,000,393 | A | 3/1991 | Madsen | 242/55.3 |
| 5,271,574 | A | 12/1993 | Formon et al. | 242/55.3 |
| 5,288,032 | A | 2/1994 | Boone et al. | 242/55.3 |
| 5,294,192 | A | 3/1994 | Omdoll et al. | 312/34.22 |
| 5,302,167 | A | 4/1994 | Kley et al. | 493/400 |
| 5,314,131 | A | 5/1994 | McCanless et al. | 242/55.3 |
| 5,375,785 | A | 12/1994 | Boone et al. | 242/560.1 |
| 5,400,982 | A | 3/1995 | Collins | 242/560 |
| 5,526,973 | A | 6/1996 | Boone et al. | 225/34 |
| 5,558,302 | A | 9/1996 | Jespersen | 242/560 |
| 5,772,291 | A | 6/1998 | Byrd et al. | 312/34.22 |
| 5,924,617 | A | 7/1999 | LaCount et al. | 225/16 |
| 6,354,533 | B1 * | 3/2002 | Jespersen | 242/560.1 |

FOREIGN PATENT DOCUMENTS

| | | | |
|---|---|---|---|
| GB | 2 003 831 | 3/1997 | B65H/35/00 |

* cited by examiner

*Primary Examiner*—Donald P. Walsh
*Assistant Examiner*—Mark J Beauchaine
(74) *Attorney, Agent, or Firm*—Jansson, Shupe & Munger, Ltd.

(57) ABSTRACT

The invention is directed to improved apparatus for dispensing flexible web material from plural rolls including improved transfer apparatus for reliably and simply dispensing material from a secondary roll once a primary roll has been depleted. The improved transfer apparatus comprises a one-piece transfer arm, first and second transfer rollers rotatably secured with respect to the transfer arm and a sensing member secured with respect to the transfer arm in position to contact the primary roll web surface. The sensing member permits movement of the transfer arm and transfer rollers to a transfer position once the primary roll diameter diminishes to a predetermined extent causing the secondary roll material to be dispensed.

18 Claims, 11 Drawing Sheets

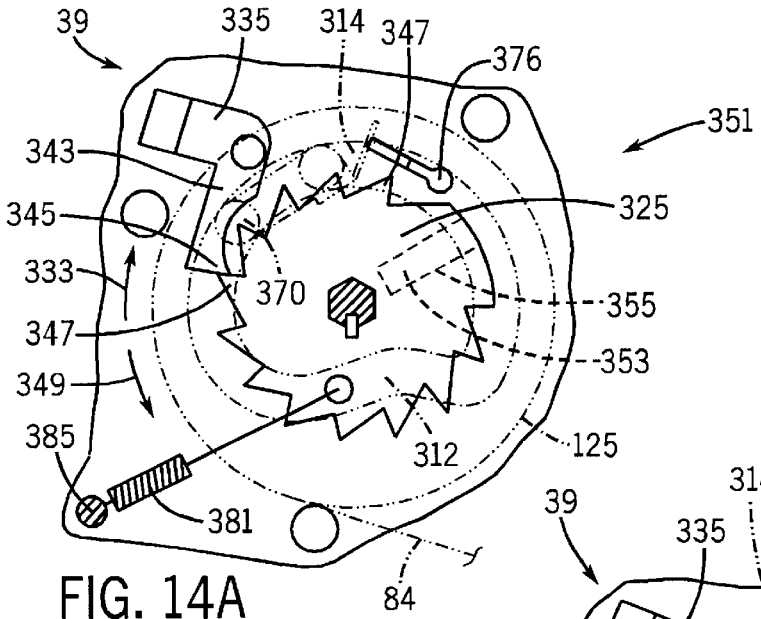
FIG. 14A
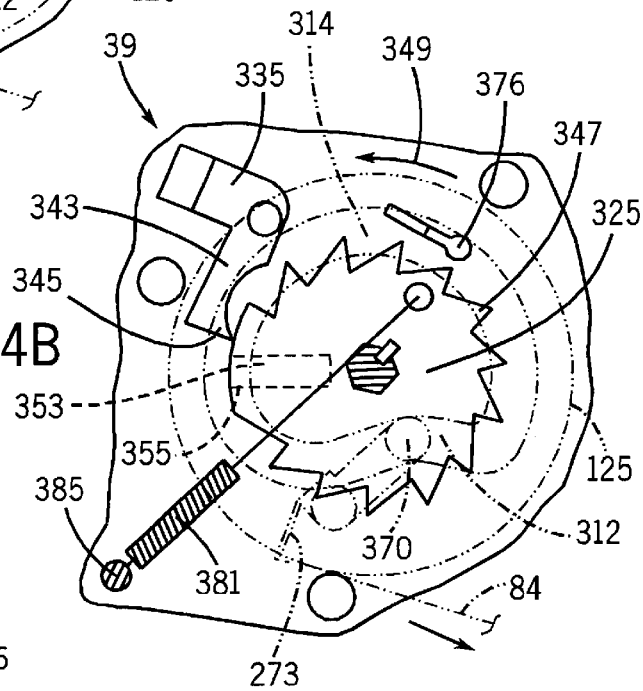
FIG. 14B
FIG. 14C
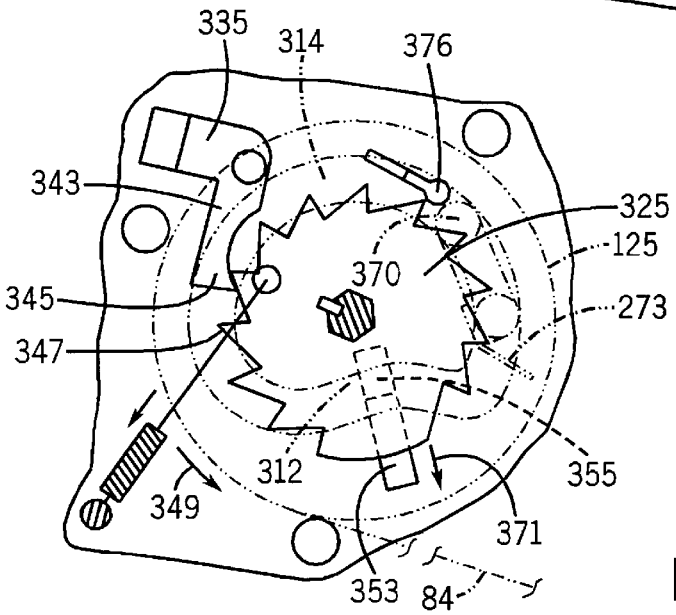
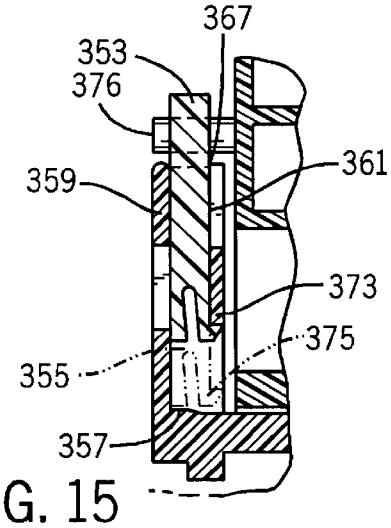
FIG. 15

DISPENSER APPARATUS WITH TRANSFER MECHANISM

FIELD OF THE INVENTION

This invention is related generally to dispensing apparatus and, more particularly, to apparatus for dispensing flexible sheet material including apparatus for dispensing from plural sources of material.

BACKGROUND OF THE INVENTION

Dispensers for flexible sheet material, such as paper toweling and the like, are well known in the art. These dispensers typically discharge the sheet material from one or more rolled webs stored within the dispenser. The material is dispensed when the user grasps the material tail, which extends outwardly from the dispenser, and pulls the tail away from the dispenser.

The web of sheet material is typically drawn from a roll on which the material is wound through a nip formed by a drive and a tension roller and then out of the dispenser. The rotational force imparted to the drive roller by the moving web material may be used to operate a cutting mechanism which completely or partially cuts the web into sheets of predetermined length. Examples of cutting mechanisms powered at least in part by the moving web material include U.S. Pat. Nos. 5,441,189 (Formon et al.), 4,621,755 (Granger), 4,122,738 (Granger) and 4,404,880 (DeLucca). In each of these patents, the cutting blade is powered to extend from the drive roller to cut the web. Of course, other types of web cutting devices, such as the stationary blade shown in U.S. Pat. No. 5,526,973 (Boone et al.), have also been used in prior dispensers.

An important issue affecting these types of dispensers involves the need to provide the dispenser with sufficient sheet material so that the dispenser can be used for extended time periods without the need for service by an attendant. One solution to this problem has been to provide the dispenser with plural sources of material, typically in the form of rolled material webs, These dispensers include a primary roll of web material which is initially dispensed and further include one or more secondary web rolls which are dispensed once the primary roll has been depleted.

A variety of transfer mechanisms have been developed in an effort to transfer the secondary roll web material to the nip once the primary roll web has been depleted. However, these mechanisms have certain disadvantages. For example, U.S. Pat. Nos. 4,010,909 (Bastian), 4,165,138 (Hedge), 4,317,547 (Graham, Jr. et al.), 4,358,169 (Filipowicz et al.), 4,403,748 (Cornell) and 4,756,485 (Bastian et al.) utilize one or more rollers mounted on complex articulated frames to urge the secondary roll material into the nip. Such arrangements are disadvantageous because the large number of moving parts required by these devices unduly adds to the cost of manufacture and assembly and increases the likelihood that the dispenser may fail during operation. These devices are further disadvantageous because they rely on complex and potentially unreliable apparatus to determine that the primary roll has been depleted.

By way of further example, U.S. Pat. Nos. 4,611,768 (Voss et al.), 4,807,824 (Gains et al.) and 5,400,982 (Collins) utilize a finger-like "tucking device" to urge the secondary roll material into the nip. Again, complex apparatus are required to make many of these devices operational. Moreover, the tucking device remains in contact with the secondary roll web material after the transfer and can place unnecessary drag and frictional forces against that web material potentially resulting in tearing of the web material.

It would be a significant improvement in the art to provide dispenser apparatus with an improved transfer mechanism that would reliably transfer web material from a secondary roll to the nip upon sensing that the primary roll material has been depleted and which would include an elegant design requiring fewer parts resulting in lower costs of manufacture and increased reliability of operation.

OBJECTS OF THE INVENTION

It is an object of this invention to provide an improved dispensing apparatus and material transfer mechanism overcoming some of the problems and shortcomings of the prior art.

Another object of this invention is to provide an improved dispensing apparatus and material transfer mechanism which provides a reliable transfer of secondary material to the nip upon depletion of the primary web material.

Yet another object of this invention is to provide an improved dispensing apparatus and material transfer mechanism which requires fewer parts than prior art material transfer mechanisms.

Still another object of this invention is to provide an improved dispensing apparatus and material transfer mechanism which has an improved design versus prior art material transfer mechanisms.

Yet another object of the invention is to provide an improved dispensing apparatus and material transfer mechanism which has a rugged design yet is economical to manufacture and assemble.

It is also an object of this invention to provide an improved dispensing apparatus and material transfer mechanism which directly senses the amount of primary material remaining to be dispensed.

An additional object of this invention is to provide an improved dispensing apparatus and material transfer mechanism which minimizes wear on the material to be dispensed.

These and other objects of the invention will be apparent from the following descriptions and from the drawings.

SUMMARY OF THE INVENTION

The invention is directed to improved apparatus for dispensing flexible web material from primary and secondary rolls including an improved transfer mechanism for reliably and simply transferring the secondary roll web to the web feed apparatus once the transfer apparatus senses that the primary roll web has been depleted to a predetermined extent. The invention represents a significant advance over prior art products because of its elegant design. The invention requires fewer parts than prior art devices. The few parts that are required are simpler, require fewer moving parts and are easier to manufacture and assemble. The device minimizes the chance for material breakage or damage. All of these design advances contribute to a less expensive, more reliable dispenser apparatus.

The apparatus includes a frame for rotatably supporting drive and tension rollers and drive and tension rollers mounted thereon. The drive and tension rollers extend across substantially the width of the web. A nip is formed at the junction of the drive and tension rollers. Web material is fed from a roll stored with respect to the dispenser, through the nip and out of the dispenser through a discharge opening. Cutter apparatus for cutting the web material into separate sheets of predetermined length is preferably included.

In broad terms, the improved transfer apparatus comprises a one-piece transfer arm, first and second transfer rollers rotatably secured with respect to the transfer arm and a sensing member secured with respect to the transfer arm in position to contact the primary roll web surface. The sensing member permits movement of the transfer arm and transfer rollers to the transfer position once the primary roll diameter diminishes to a predetermined extent.

The transfer arm is mounted for movement with respect to the frame between a ready position and a transfer position and is biased toward the transfer position. The first and second transfer rollers are configured and designed to extend only partially across the tension and drive rollers respectively. In the ready position, the first and second transfer rollers are preferably spaced apart from the drive and tension rollers. In the transfer position, the first and second transfer rollers engage an edge portion of the secondary roll web and urge such edge portion against the tension and drive rollers respectively causing the secondary roll web to be drawn into the nip for dispensing from the apparatus. The sensing member preferably rides directly against the outer surface of the primary roll web and permits movement of the transfer arm toward the transfer position as the primary roll web diminishes in diameter.

The preferred transfer arm comprises a one-piece component with first and second ends. The transfer rollers are mounted along the first end and the sensing member is mounted along the second end. The transfer arm is preferably designed with an upper section including the first end and a and lower section including the second end. The upper and lower sections of the transfer arm meet to form an obtuse angle. It is highly preferred that the transfer arm is mounted for pivotal movement at a single transfer arm pivot axis. This advantageous arrangement permits the transfer rollers to be easily moved toward the respective drive and tension rollers as the transfer mechanism moves to the transfer position.

In highly preferred embodiments, the transfer rollers are secured to a transfer roller arm. The transfer roller arm is movably secured along the transfer arm first end. The transfer rollers are configured and designed to contact only one edge of the secondary roll web. It has been found that a transfer roller width (also referred to herein as an axial length) of approximately 15 mm is highly desirable.

It is highly preferred for the inventive transfer mechanism to include biasing apparatus for urging the sensing member directly against the primary roll outer edge. The biasing apparatus maintains direct contact between the sensing member and the primary roll web surface ensuring reliable movement of the transfer apparatus to the transfer position. A spring is a suitable form of biasing apparatus for use with the invention.

The invention's compact design and use of a single transfer arm with transfer rollers which extend only partially across the drive and tension rollers dispenses with any need for bulky structures which span the entire width of the dispenser and which require multiple articulated frames to support such structures. The smooth surfaces of the preferred transfer rollers minimize wear on the material to be dispensed.

BRIEF DESCRIPTION OF THE DRAWINGS

The drawings illustrate preferred embodiments which include the above-noted characteristics and features of the invention. The invention will be readily understood from the descriptions and drawings. In the drawings:

FIGS. 14A–14D are enlarged partial sectional views of the exemplary stop mechanism of FIGS. 3–5 showing operation of the stop mechanism.

FIG. 15 is a top sectional view of stop member and stop constraint surfaces taken along section 15—15 of FIG. 4.

DETAILED DESCRIPTION OF PREFERRED EMBODIMENTS

Figure 1:
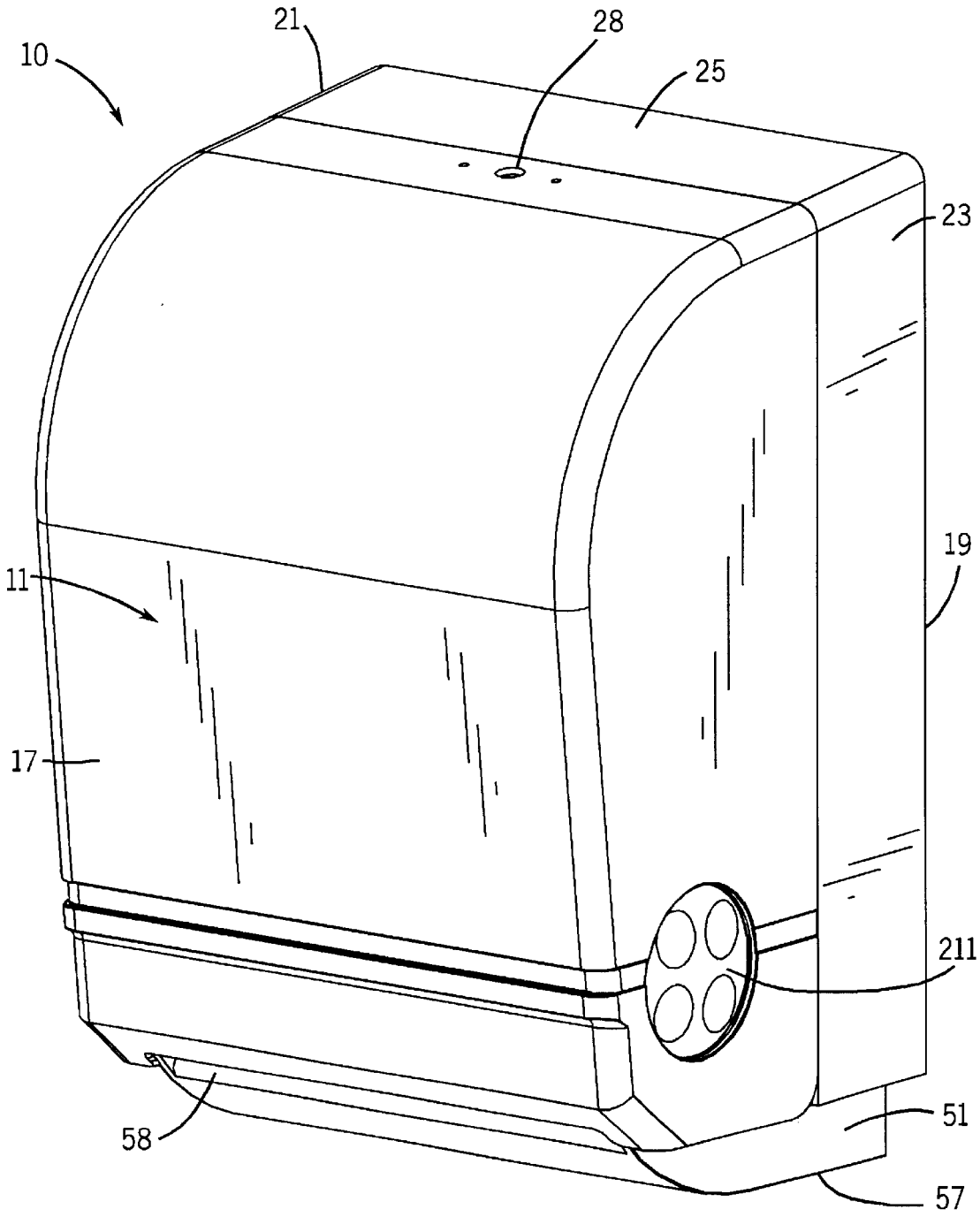
FIG. 1 is a perspective view of a preferred dispenser in accordance with this invention.
Figure 2:
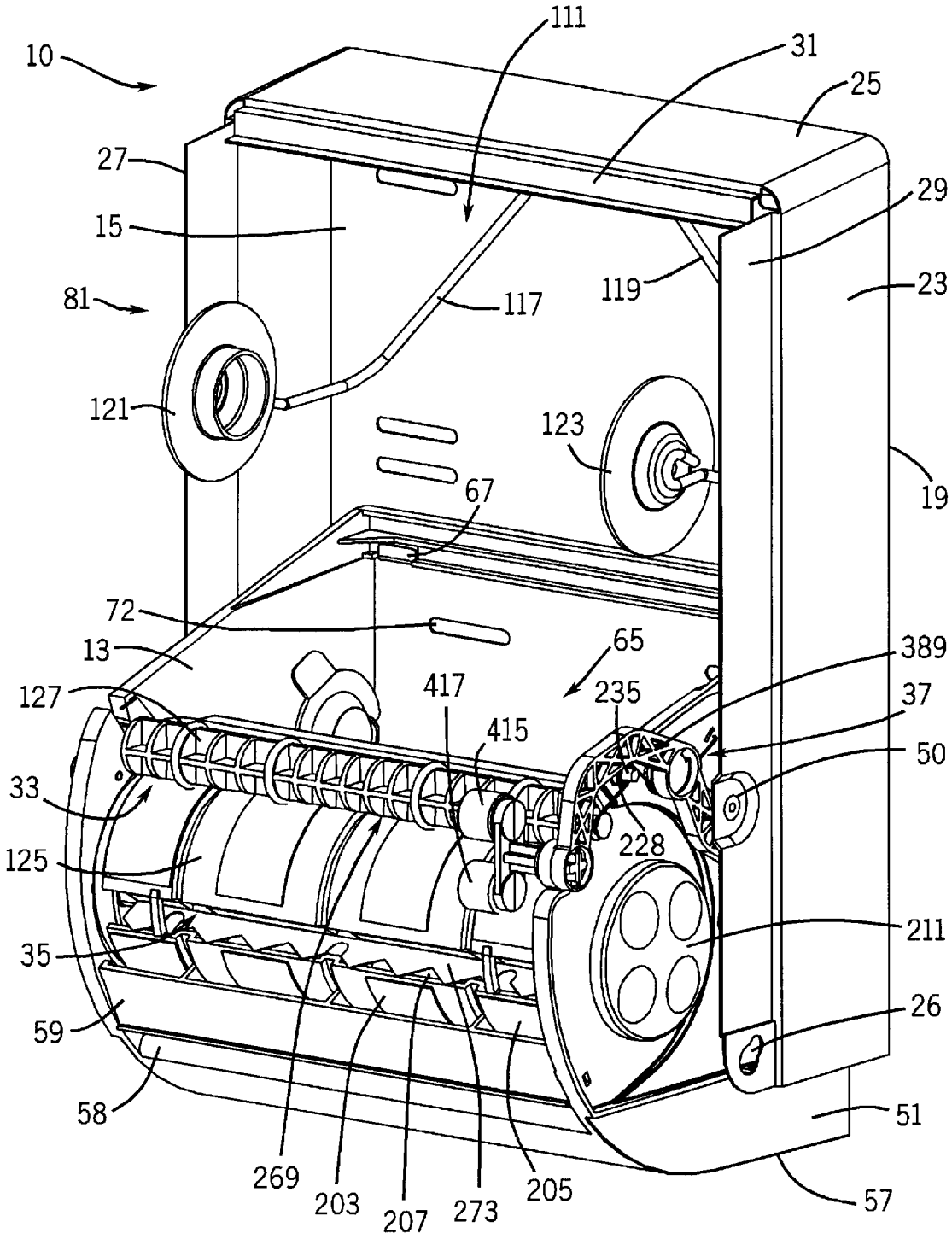
FIG. 2 is a perspective view of the dispenser of FIG. 1 with the housing cover removed.
Figure 3:
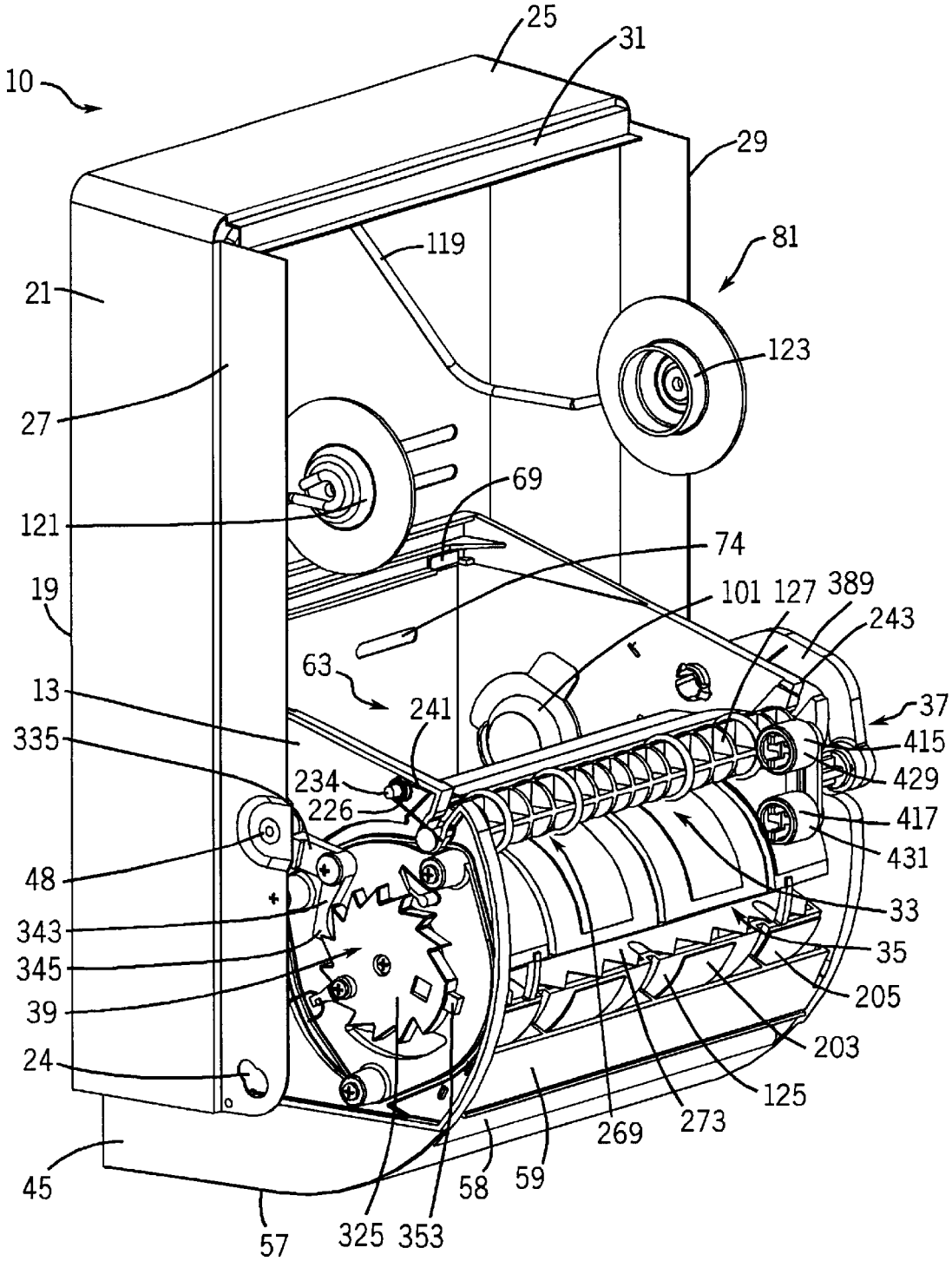
FIG. 3 is another perspective view of the dispenser of FIG. 1 also with the housing cover removed.

The mechanical components comprising preferred embodiments of an exemplary dispenser 10 according to the invention will first be described. Dispenser 10 preferably includes housing 11 and frame 13 mounted within an interior portion 15 of housing 11. Housing 11 includes a front cover 17, rear wall 19, side walls 21 and 23 and top wall 25. Cover 17 may be connected to housing 11 in any suitable manner. As shown in FIGS. 1–3, cover 17 is attached for pivotal movement to housing 11 by means of axially aligned pins (not shown) in cover 17 configured and arranged to mate with respective openings 24 and 26 in housing side walls 21 and 23. A lock mechanism 28 may be provided in cover 17 to prevent unauthorized removal of cover 17. Alternatively, cover 17 could be held in place by a friction fit between cover inner wall surfaces (not shown) and sidewall cover-engagement surfaces 27, 29 and top wall cover-engagement surface 31. Cover 17 is removed, for example, to load web material into dispenser 10 or to service dispenser 10. Housing 11 and cover 17 may be made of any suitable material. Formed sheet metal and molded plastic are particularly suitable materials for use in manufacturing housing 11 and cover 17 because of their durability and ease of manufacture.

Figure 4:
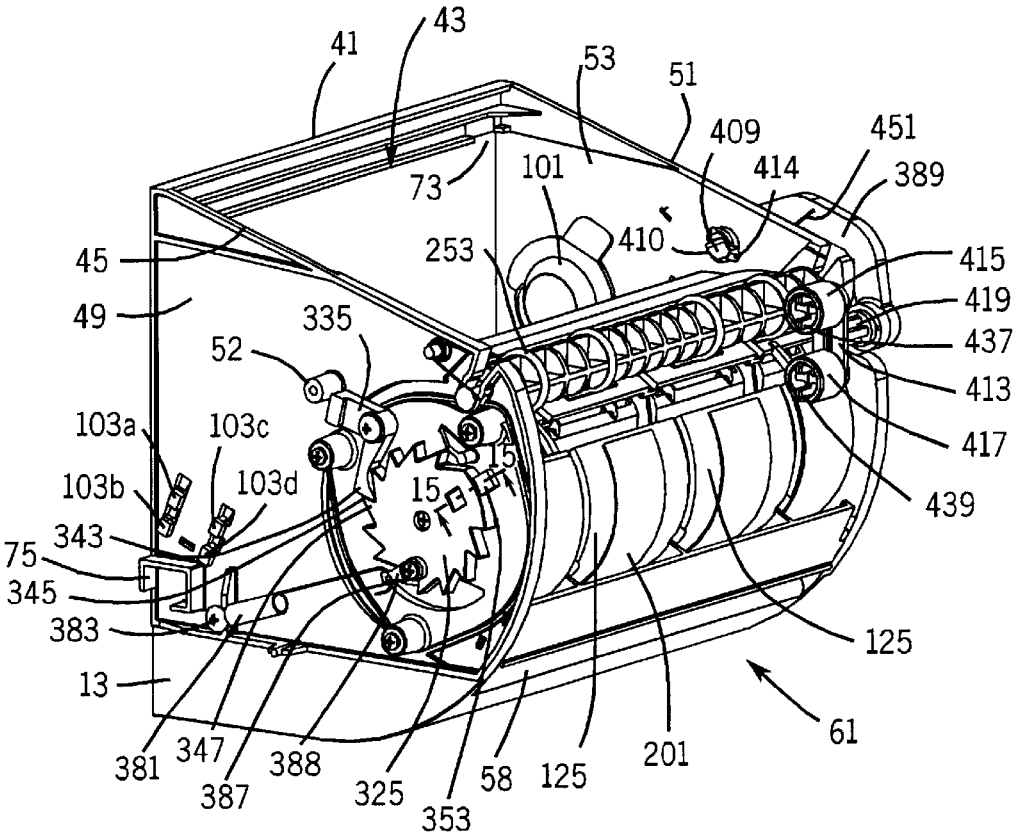
FIG. 4 is a perspective view of the dispenser frame.
Figure 6:
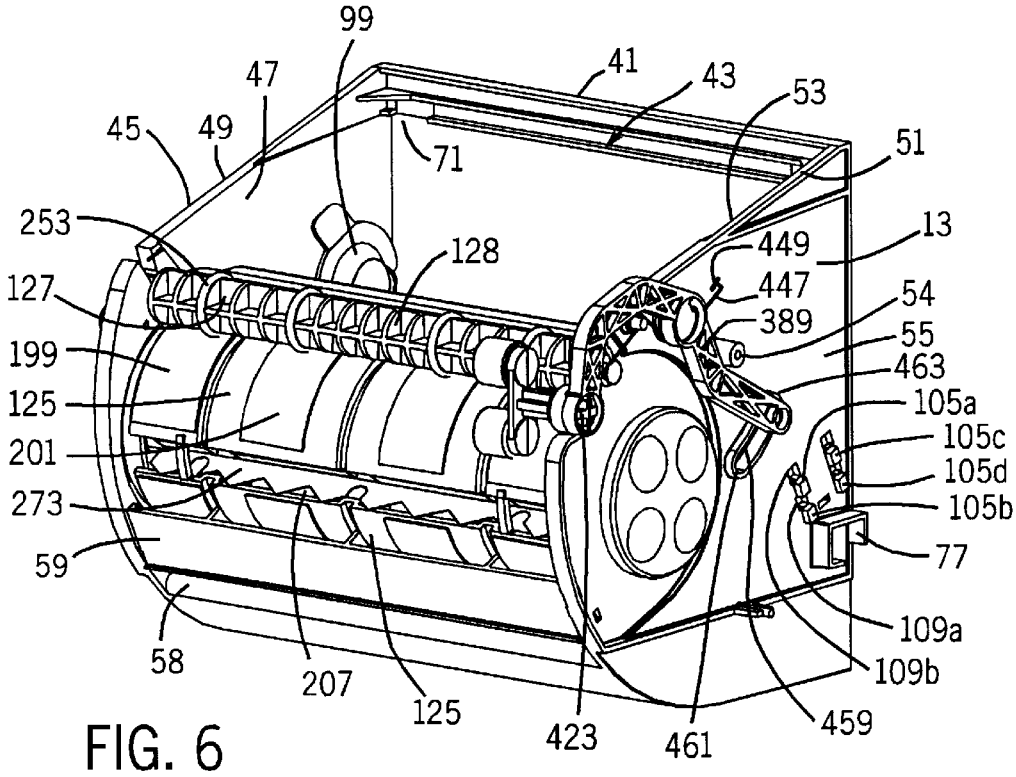
FIG. 6 is a perspective view of the dispenser frame.
Figure 5:
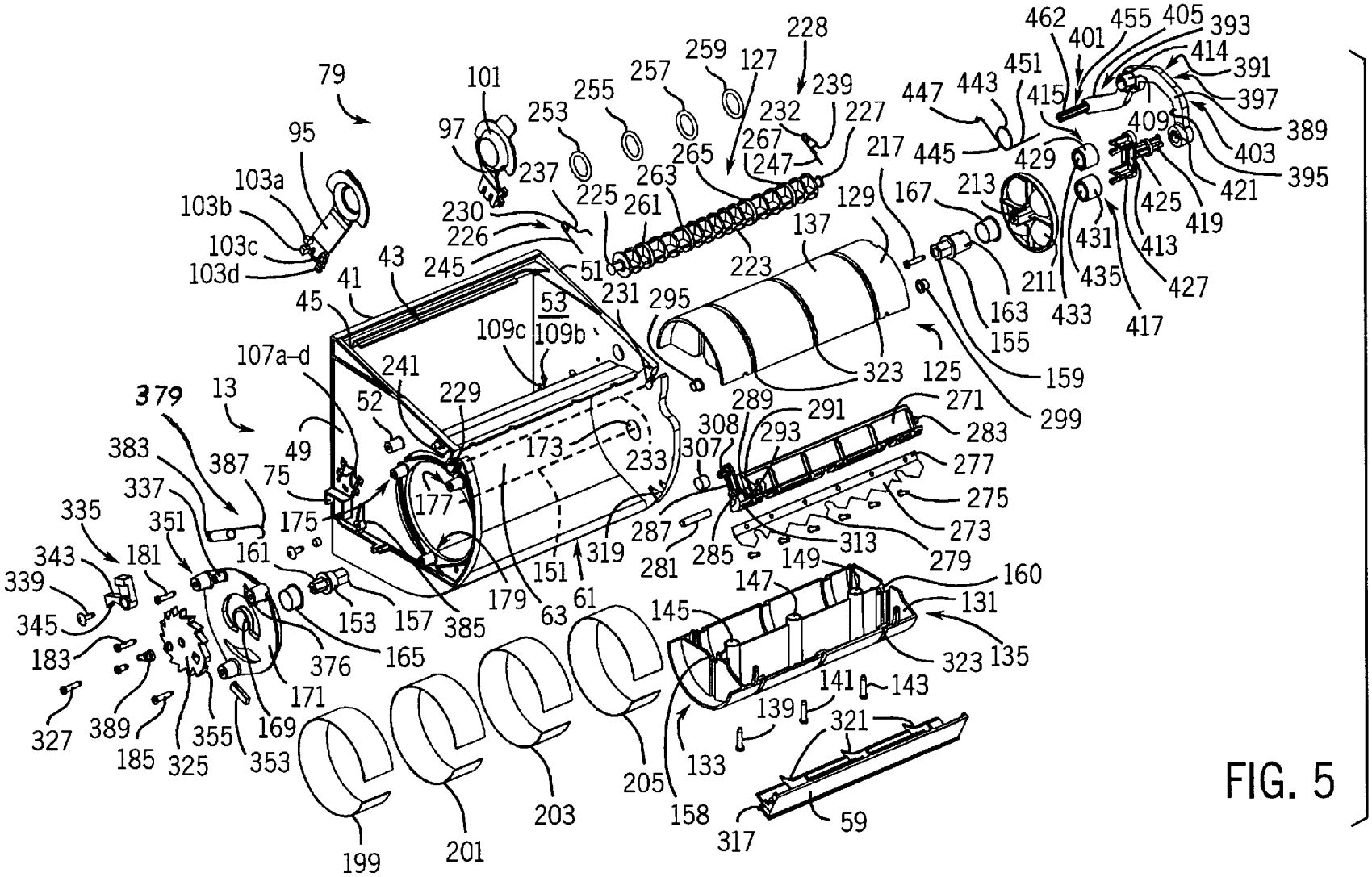
FIG. 5 is an exploded perspective view of the frame and certain preferred mechanical components mounted with respect to the frame.

Frame 13 and the principal mechanical components of exemplary dispenser 10 are shown in FIGS. 2 and 3 in which cover 17 is removed from dispenser 10 and in FIGS. 4–6 in which frame 13 is apart from housing 11. Frame 13 is preferably positioned within a portion of housing interior 15 as shown in FIGS. 2 and 3. Frame 13 is provided to support the major mechanical components of dispenser 10 including the paper feeding means 33, paper cutting means 35, paper transfer means 37 and positive stop means 39. Frame 13 is made of a material sufficiently sturdy to resist the forces applied by these moving parts mounted thereon. Molded plastic is a highly preferred material for use in manufacture of frame 13.

Frame 13 includes a rear support member 41 having an inner surface 43 (the preferred frame 13 does not include a full rear wall), a first sidewall 45 having sidewall inner 47 and outer 49 surfaces, a second sidewall 51 having sidewall inner 53 and outer 55 surfaces and bottom wall 57. Web discharge opening 58 is provided between bottom wall 57 and optional drum guard 59. Side walls 45 and 51 define frame front opening 61. As shown best in FIG. 5, frame 13 also includes arcuate web-guide surface 63. Housing rear wall 19 and frame walls, 45, 51, 57 and 63 define a space 65 in which primary web roll (described below) can be positioned for storing and dispensing.

Frame 13 is preferably secured along housing rear wall 19 in any suitable manner such as with restraint elements 67, 69 provided in housing rear wall 19. Restraint elements 67, 69 mate with corresponding slots 71 and 73 provided in frame rear member 41. Frame 13 may also be secured in housing 11 by mounting brackets 75, 77 provided along frame sidewall outer surfaces 49, 55 for mating with corresponding brackets (not shown) provided in housing 11. Frame 13 may further be secured to housing 11 by means of fasteners 48, 50 positioned through housing sidewalls 21, 23 and posts 52, 54. Frame 13 need not be a separate component and could, for example, be provided as an integral part of housing 11.

The exemplary dispenser 10 may be mounted on a vertical wall surface (not shown) where dispenser 10 can be easily accessed by a user. As shown particularly in FIGS. 2 and 3, dispenser 10 could be secured to such vertical wall surface by suitable fasteners (not shown) inserted through openings, such as slots 72, 74, provided in housing rear wall 19. Of course, dispenser 10 could be configured in other manners depending on the intended use of dispenser 10.

Figure 7:
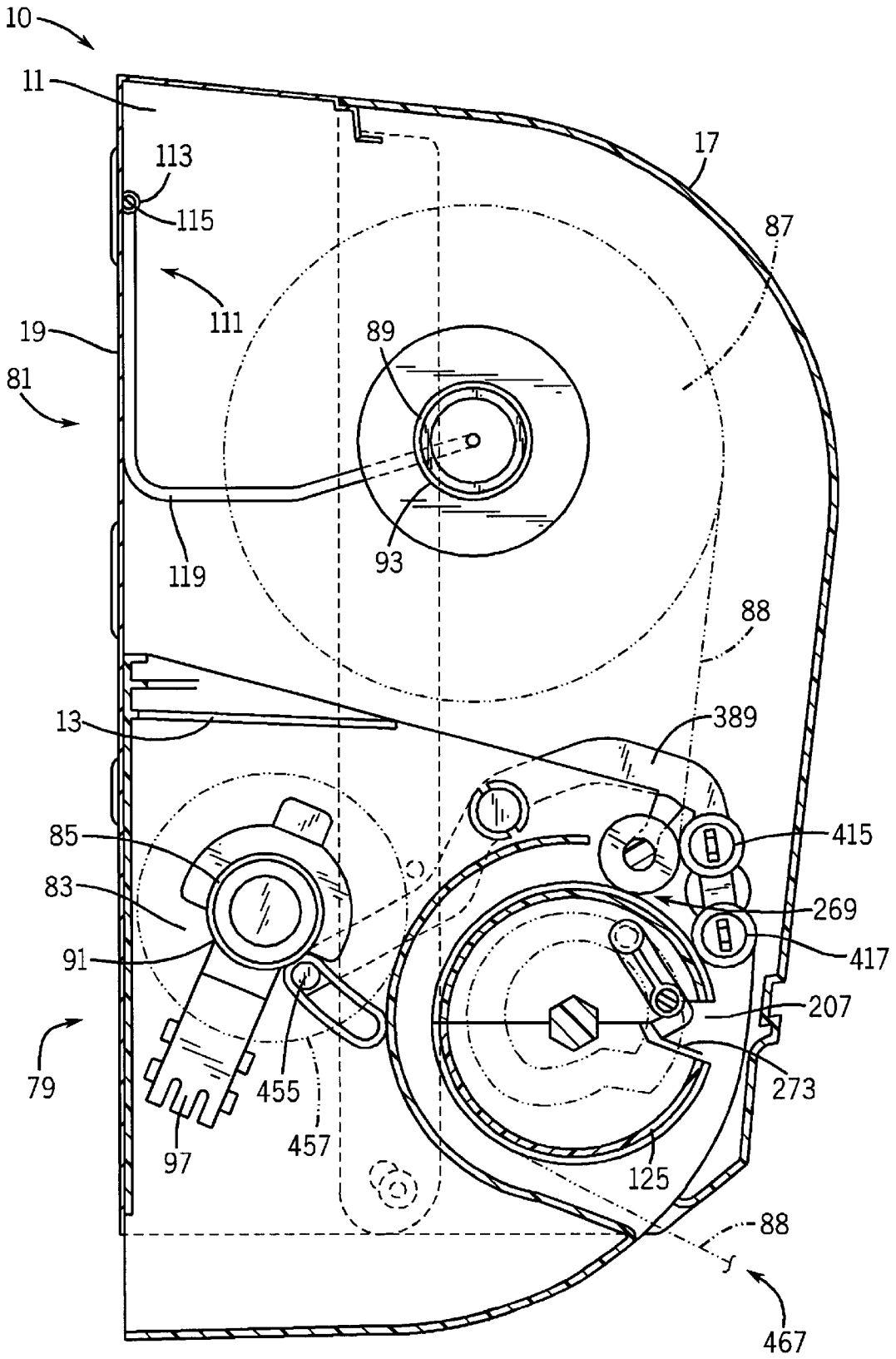
FIG. 7 is a somewhat diagrammatical side elevation view, with portions thereof in section, of a web material dispenser according to the present invention.
Figure 8:
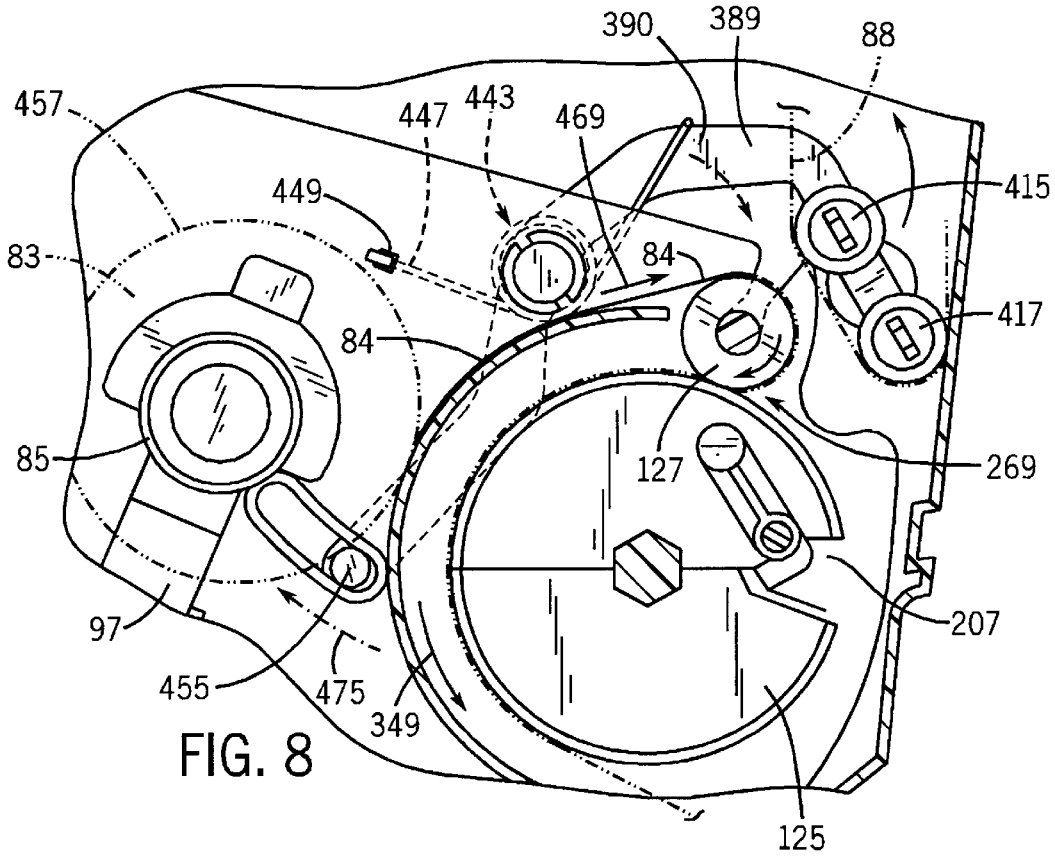
FIG. 8 is an enlarged partial sectional view of the drive roller and transfer ,mechanism of the dispenser of FIG. 7. The transfer mechanism is positioned in the ready position.

The preferred dispenser apparatus 10 includes means 79 for supporting a primary source of sheet material (FIGS. 2–8, 10) and means 81 for supporting a secondary source of sheet material (FIGS. 2–3, 7). The sheet material is preferably provided in the form of a material web rolled onto a hollow core having an axial length. Such cores are typically made of a cardboard-like material. FIG. 7 shows a primary web roll cylindrically-shaped core 85. The primary web roll 83 on core 85 is shown in FIG. 7 as being depleted of web material. However, the phantom line representation of web 83 is provided to illustrate an exemplary web 83 loaded on arms 95, 97 including web 83 outer surface 457. FIG. 7 further shows a secondary web roll 87 wound on cylindrically-shaped core 89. Each core 85, 89 has one end 91, 93 as shown in FIG. 7 and an identical second end which is not shown. As shown in FIG. 8, primary web 84 is being dispensed while secondary web 88 is in a "ready" position prior to dispensing from that source.

It is very highly preferred that the web material, such as web rolls 83 and 87, be stored in and dispensed from housing interior 15 or from frame 13 within housing 11. However, there is no absolute requirement that such rolls be contained within housing interior 15 or space 65.

Turning now to the preferred means 79 for supporting primary web roll 83, such supporting means 79 includes support arms 95 and 97 secured to respective frame side walls 45 and 51 and web roll support cups 99 and 101 mounted on respective arms 95 and 97. Arms 95 and 97 are secured along respective side wall inner surfaces 47, 53 by mounting elements 103*a–d* and 105*a–d* positioned in respective slots 107*a–d* and 109*a–d* provided in side walls 41 and 45. Arms 95 and 97 are preferably made of a resilient material so that they may be spread apart to receive between them end 91, and identical opposite end, of primary web roll hollow core 85.

FIGS. 2–3 and 7 show a preferred means 81 for supporting secondary web roll 87. Supporting means 81 includes yoke 111 attached in a suitable manner to housing rear wall 19, such as by bracket 113 secured to yoke center section 115 (FIG. 7). Yoke 111 comprises arms 117 and 119 and web roll support cups 121, 123 mounted on respective arms 117, 119. Arms 117 and 19 are preferably made of a resilient material so that they may be spread apart to receive hollow core roll 89 on which the secondary web roll 87 is wound.

Persons of skill in the art will appreciate that support structure, other than arms 95–97, 117–119 and cups 99–101, 121–123 could be used to support primary and secondary web rolls 83 and 87. By way of example only, primary web roll 83 could be supported by a single removable rod spanning between frame walls 45, 51. Moreover, primary web roll 83 could simply rest on frame bottom wall 57 without support at the roll ends.

A preferred means 33 for feeding the web material 84, 88 from respective rolls 83, 87 will next be described. Such feeding means 33 comprises drive roller 125, tension roller 127 and the related components as hereinafter described and as shown particularly in FIGS. 2–6.

Figure 5A:
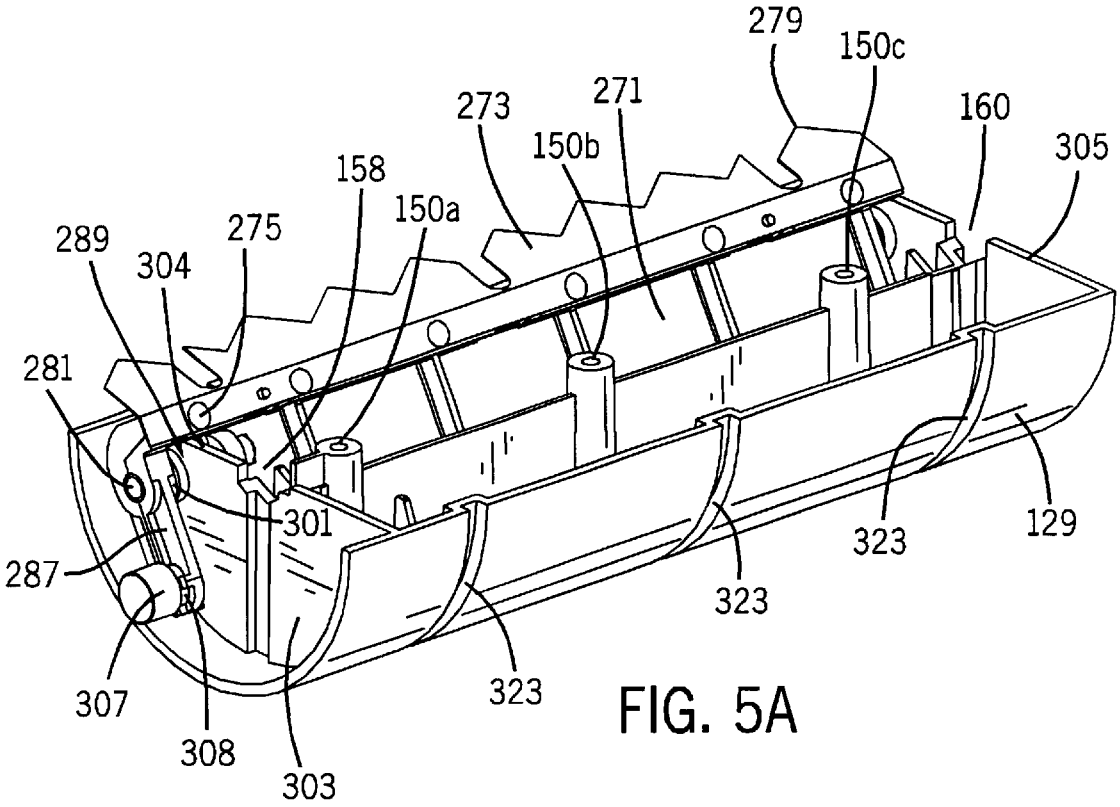
FIG. 5A is a perspective view of a drive roller first section showing a blade carrier positioned for pivotal movement within the drive roller.
Figure 5B:
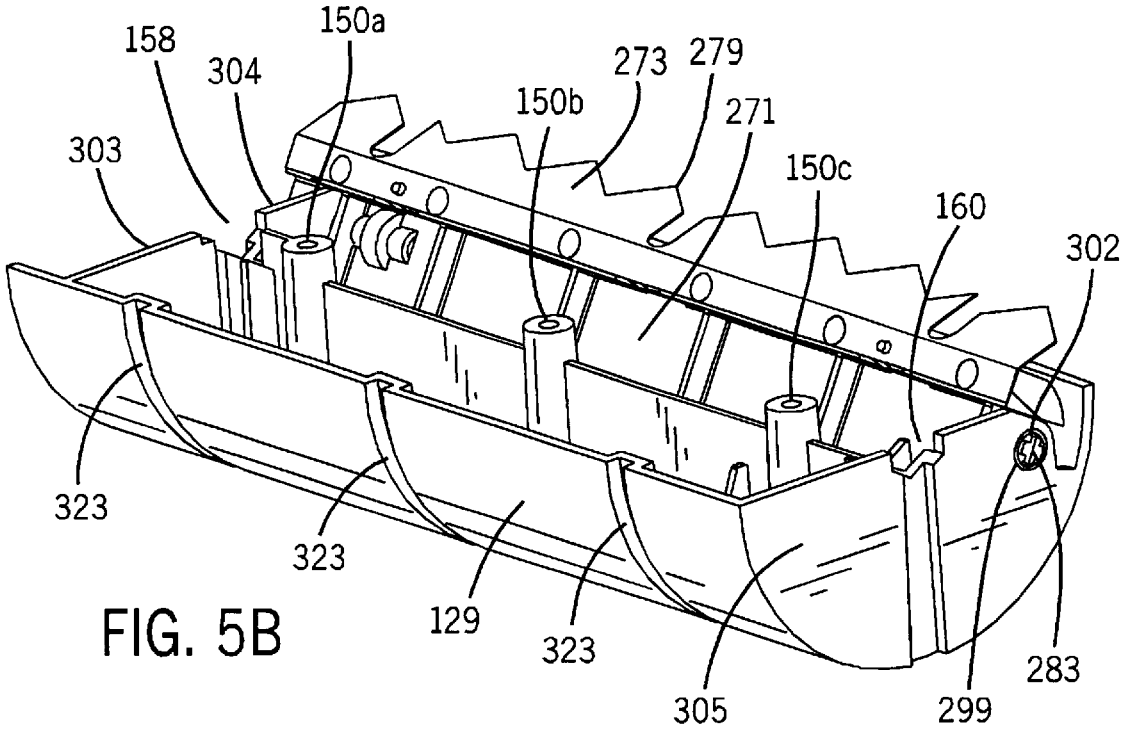
FIG. 5B is a another perspective view of the drive roller first section showing the blade carrier positioned for pivotal movement within the drive roller.

Preferred drive roller 125 is a cylindrical, drum-shaped member consisting of first and second drum sections 129 and 131, first and second ends 133 and 135 and outer surface 137. Drum sections 129 and 131 may be made of any suitable material and may be joined in any suitable manner, such as by fasteners 139–143 positioned through drum second section openings 145–149 and corresponding openings such as openings 150*a–c* in drum section 129 as shown in FIGS. 5A–B.

Drive roller 125 is preferably mounted on frame 13 along axis 151. Drive roller 125 is mounted for bidirectional rotatable movement by stub shafts 153 and 155 which extend axially outwardly from opposed drive roller ends 133 and 135. Each stub shaft 153 and 155 has an inner end 157, 159 connected to a respective drive roller opening 158, 160. Stub shaft inner ends 157, 159 and openings 158, 160 may be keyed (such as with the hexagonal shape shown in FIG. 5) to ensure a more positive union. Stub shaft outer ends 161, 163 are journaled in a respective low-friction bushing 165, 167 (such as a nylon bushing) or a sleeve bearing (not shown).

Bushing 165 is positioned in opening 169 provided in cam plate 171 secured along frame wall 45 while bushing 167 is positioned in opening 173 in frame wall 51. Cam plate 171 is secured to posts 175–179 by means of suitable threaded fasteners 181–185.

Drive roller outer surface 137 preferably includes one or more friction surfaces 199–205 for engaging and gripping the web material 84, 88. Friction surfaces 199–205 are provided to ensure that drive roller outer surface 137 has sufficient frictional contact with web material 84, 88 so that the drive roller 125 will rotate as such web material positioned across drive roller 125 is pulled from the dispenser 10.

The plural friction surfaces 199–205 shown in FIGS. 2–6 are in the form of sheet-like strips adhered to drive roller outer surface 137 with a suitable adhesive (not shown). However, such friction surfaces 199–205 could be provided in other manners, such as by forming such friction surfaces directly in outer surface 137. Further, the friction surfaces 199–205 need not be limited to the plural strip-like material shown and could comprise any appropriate configuration, such as a single sheet of material (not shown). Friction surfaces 199–205 may consist of any suitable high-friction material, such as grit or rubberized material.

Drive roller 125 preferably further includes a longitudinal opening 207 through which a cutting blade 273 extends to perforate the web roll material 84, 88 as hereinafter described.

As shown particularly in FIG. 5, hand wheel 211 linked to driver roller 125 may optionally be provided. Hand wheel 211 is provided to permit manual rotation of drive roller 125, such as to feed the web roll material 84, 88 out from the dispenser 10 through discharge opening 58 at the time web material is being loaded into the dispenser 10. Hand wheel 211 is linked. to drive roller 125 at end 135 by means of a hand wheel post 213 keyed to fit into corresponding female opening (not shown) in the outer end 163 of stub shaft 155. A suitable fastener, such as threaded fastener 217 may be positioned through stub shaft 155 and into handwheel 211 to further secure the linkage between hand wheel 211 and drive roller 125.

The preferred web feeding means 33 further includes apparatus for urging the web material against drive roller 125. In the embodiment shown, tension roller 127 and its related components serve this purpose. Tension roller 127 is preferably a generally cylindrically-shaped member consisting of an outer surface 223 and first and second axial stub ends 225 and 227. Tension roller 127 is preferably a one-piece molded plastic part which may include ribs 128 for added rigidity. However. any suitable tension roller 127 structure may be used.

Tension roller axial stub ends 225 and 227 are configured to fit rotatably in respective slots 229 and 231 provided in frame side walls 45 and 51. Tension roller 127 is generally coextensive with drive roller 125 and is mounted along an axis 233 parallel to drive roller axis 151.

As shown in FIGS. 3–6, torsion springs 226 and 228 are provided to urge tension roller 127 against drive roller 125. Torsion springs 226 and 228 have loops 230 and 232 mounted on respective posts 234 and 235. Each torsion spring has one spring arm 237, 239 in contact with a respective frame shoulder 241 or 243 and another spring arm 245, 247 is in contact with a respective tension roller axial stub end 225 or 227.

Tension roller 127 may be provided with annular gripping surfaces 253–259 positioned in annular seats 261–267 and positioned to abut respective drive roller friction surfaces 199–205. Such gripping surfaces 253–259 are preferably made of a tactile material such as rubber, or the like.

Nip 269 is formed at the interface of the drive 125 and tension 127 rollers. As will be explained fully below, the nip 269 is provided to positively engage the web roll material 84, 88 and to draw such material from the respective roll 83, 87 and against the drive roller friction surfaces 199–205 so that web material 84, 88 can be dispensed from the dispenser 10.

A preferred cutter means 35 for cutting the web roll material 84, 88 is shown in FIGS. 2–7 and 11–13. The cutter mechanism 35 is preferably provided to partially cut web roll material 84, 88 positioned against drive roller 125 as drive roller 125 rotates under the force applied by the pulling of such web material from the dispenser 10. Other types of cutter mechanisms may be used in conjunction with the invention.

The exemplary cutter mechanism 35 comprises a carrier 271 to which blade 273 is secured by suitable fastening means, such as illustrative rivet 275 positioned through corresponding opening 277 in blade 273 and corresponding opening (not shown) in carrier 271.

Blade 273 is provided with a plurality of spaced-apart teeth 279 longitudinally spaced along the blade. This arrangement permits teeth 279 to perforate, rather than completely sever, the web roll material 84, 88.

As best shown in FIGS. 5–5B, carrier 271 is mounted for pivotal movement within drive roller 125 on axially opposed shafts 281, 283. Shaft 281 is preferably a pin which is inserted: (1) through cored hole 285 in arm 287, (2) across gap 289 formed between arm 287 and carrier end 291 and (3) into coaxial cored hole 293 in carrier end 291. A shouldered bearing 295 is journaled on shaft 281 along that portion of shaft 281 spanning gap 289. Shouldered bearing 295 is then positioned in opening 301 provided in first drum section end wall 303. With respect to the other opposed shaft 283, that shaft is journaled into shouldered bearing 299. Bearing 299 is positioned in an identical opening 302 coaxially aligned with opening 301 and provided in an end wall 305 of first drum section. This arrangement permits carrier 271 to be supported for pivotal movement within drive roller 125 along shafts 281, 283 inserted into respective walls 303 and 305.

Arm 287 is provided to support cam follower 307. Cam follower 307 is rotatably mounted on post 308 provided along arm 287. Arm 287 and cam follower 307 are positioned for mounting outside of first drum section end wall 303 so that cam follower 307 may be positioned in cam track 309 of stationary cam 311. In order to accommodate this mounting relationship, arm 287 is linked to carrier 271 by arm support member 313 provided at end 291 of carrier 271 forming the previously described gap 289 between arm 287 and carrier end 291. The arm support member 313 is positioned through recessed portion 304 of first drum section end wall 303 which is cut away sufficiently for such support member 313 to be positioned through end wall 301. This advantageous arrangement permits carrier 271 to be mounted for movement within drive roller 125 (along shafts 281, 283) and arm 287 to be positioned outside of drive roller 125 so that cam follower 307 is positionable within cam track 309.

Figure 13:
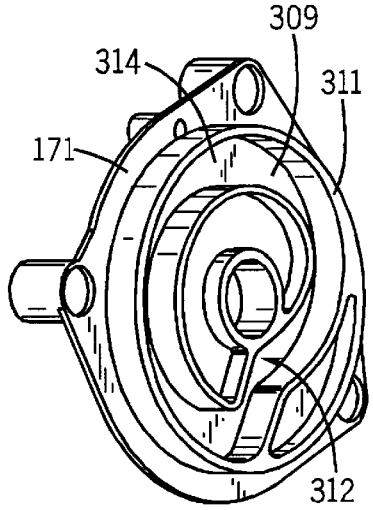
FIG. 13 is a perspective view of an exemplary cam plate and stationary cam.
Figure 11:
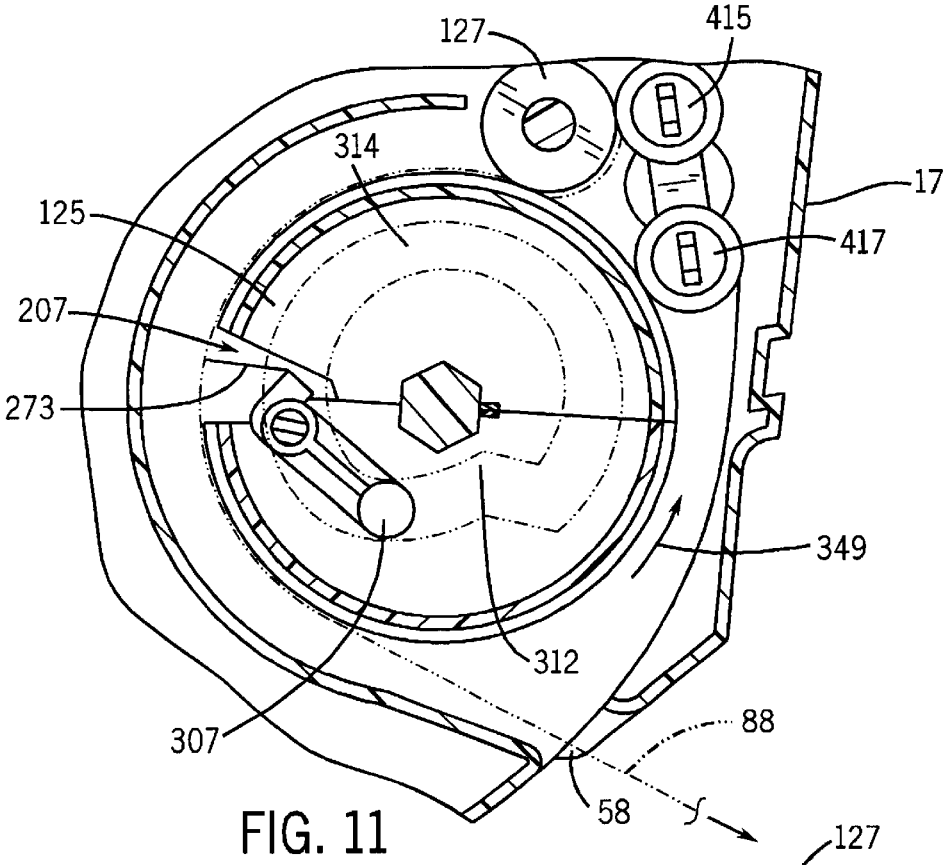
FIG. 11 is an enlarged sectional view of the drive roller and cutter apparatus of the dispenser of FIG. 7. The cutter apparatus is shown in a retracted position within the drive roller.
Figure 12:
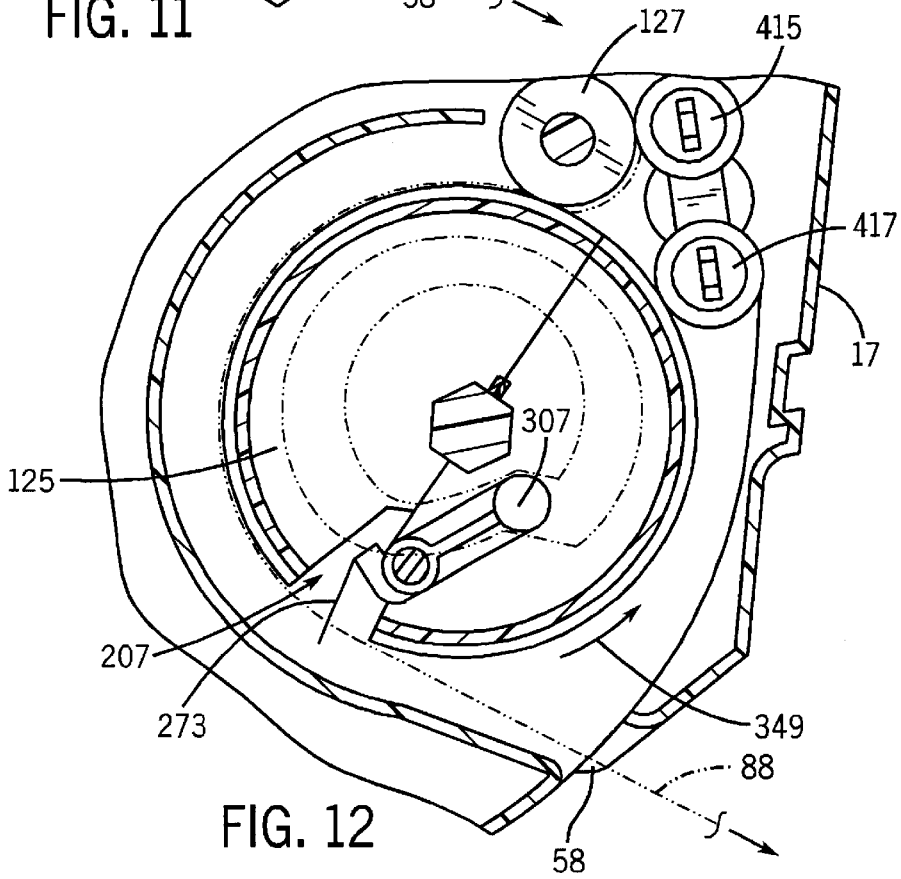
FIG. 12 is a view similar to FIG. 11 showing the drive roller and cutter apparatus. The cutter apparatus is shown in an extended position for perforating the web.

FIGS. 5 and 13 illustrate exemplary stationary cam 311. Cam 311 is preferably mounted on cam plate 171 and faces drive roller 125 and cam follower 307. Cam track 309 provided in cam 311 includes inwardly arcuate portion 312 and outwardly arcuate portion 314. Cam follower 307 follows cam track 309 as the drive roller 125 rotates during a dispensing cycle. The action of cam track 309 on cam follower 307 and linked carrier 271, causes blade 273 to be extended from drive roller 125 to perforate the web material 84, 88 and the action of cam track 309 on follower 307 also causes blade 273 to be retracted back into driver roller 125 during each revolution of drive roller 125 as described more fully below.

Drum guard 59 is optionally provided to ensure that web roll material 84, 88 does not become adhered to the drive roller (such as by static electricity) and to ensure that the web material is properly directed out of dispenser 10 through discharge opening 58. Drum guard 59 may be attached across frame front opening 61 by any suitable means, such as by tangs of which tang 317 is illustrative, such tangs engaging corresponding female tang-receiving openings in frame walls 45 and 51, such as tang receiving opening 319 shown in frame wall 51.

Drum guard 59 includes plural teeth 321 positioned to extend into corresponding annular grooves 323 around the circumference of drive roller outer surface 137. The action of teeth 321 in grooves 323 serves to separate any adhered web material 84, 88 from the drive roller 125 and to direct that material through the discharge opening 58.

Dispenser 10 includes an improved positive stop means 39 shown in FIGS. 3–5 and A–D. The positive stop mechanism 39 is provided to ensure that a single sheet of web material is dispensed each time a person pulls the web material 84, 88 from the dispenser 10. This control makes the dispenser 10 easier to use since the user will not be inconvenienced by discharge of unduly long pieces of web material in a single dispensing cycle. Further, the improved stop mechanism 39 makes the dispenser 10 more efficient by limiting the amount of web material 84, 88 discharged to that amount actually desired by the user.

The improved stop mechanism 39 includes a rotatable drive roller stop support structure 325, preferably in the form of a toothed wheel. Wheel 325 is preferably linked for rotational movement with the drive roller 125 by means of stub shaft 153. As shown in FIG. 5, stub shaft outer end 161 is inserted into female stub shaft receiving opening (not shown) on wheel 325. Stub shaft outer end 161 and female stub shaft receiving opening (not shown) are preferably keyed to the shape of the other (such as with the hexagonal shape shown in FIG. 5) to ensure a more secure union of the linkage. Wheel 325 is further secured to stub shaft 153 by a suitable fastener, such as threaded fastener 327 inserted into wheel 325 and stub shaft 151. This linkage permits wheel 325 to co-rotate with drive roller 125. The linkage further permits rotation of the drive roller 125 to be stopped by stopping rotation of wheel 325.

Rotation of wheel 325 in the direction of arrow 333 in FIGS. 14A–D (i.e. clockwise in the example shown) is controlled by limitation means in the preferred form of a wheel stop 335. Wheel stop 335 is mounted on cam plate 171 on wheel stop post 337 by means of a suitable fastener such as threaded fastener 339. Wheel stop 335 includes arm 343 and tooth-engaging finger 345 positioned to ride over the teeth 347 spaced around wheel 325 when the drive roller 125 and wheel 325 are rotated in the direction of arrow 349 in FIGS. 14A–D (i.e. counter clockwise in the example shown) and to engage a tooth 347 after limited rotation of wheel 325 and drive roller 125 in the direction of arrow 333. The irregular pattern of teeth 347 along wheel 325 permits an appropriate amount of movement of wheel 325 in the direction of arrow so that the stop mechanism 39 can be disengaged when the mechanism is in the stop position as described below.

Figure 14D:
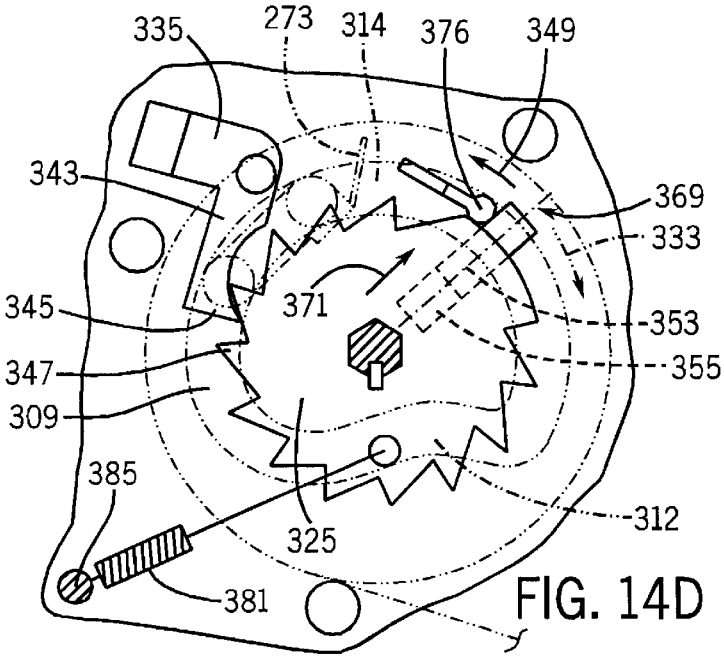

The stop mechanism 39 further includes movable drive roller stop means 351 which is provided to stop rotation of the drive roller 125. The stop means 351 moves between a "ready" position (FIG. 14A) and a "stop" position (FIG. 14D). The stop means 351 comprises a stop member 353 mounted with respect to the preferred toothed wheel 325 and constraint surfaces, such as those formed by exemplary pocket 355, for limiting movement of the stop member 353. Alternative arrangements may be used, such as mounting stop member 353 along an outside surface of wheel 325 with male posts provided to mate with slots in stop member 353 thereby restraining movement of stop member 353.

As shown in FIGS. 3–5, 14 and 15, preferred stop member 353 has a rectangular shape. Stop 353 is sized for movement in pocket 355. Pocket 355 includes bottom wall 357 and side walls 359–365 which define opening 367. Collectively, these walls constrain movement of stop 353 positioned therebetween. In the embodiment shown, stop member 353 is mounted for back-and-forth movement along an axis 369 (FIG. 14D) along a wheel radius. In this arrangement, stop member 353 extends outwardly in the direction of arrow 371 to the stop position and retracts inwardly in the opposite direction to the ready position.

As shown in FIG. 15, stop member 353 may be provided with a shoulder 375 which abuts pocket shoulder 373. Such shoulders 373, 375 are positioned to abut when the stop member 353 is in the fully-extended stop position thereby preventing stop member 353 from sliding completely out of pocket 355.

Drive roller stop engagement means 376 is provided in the form of a post projecting outwardly from cam plate outer surface 377. Post 376 is positioned to engage stop 353 when the stop 353 is in the stop position.

It is highly preferred that the stop mechanism 39 further include means 379 for biasing drive roller 125 toward rotation in at least the direction of arrow 333 (i.e. clockwise in the example shown) in order to release force against stop member 353 after it contacts post 376 so that stop member can return to the ready position. Biasing mechanism 379 may also be provided to power drive roller 125 rotation in the direction of arrow 349 (i.e. counter clockwise in the example shown) thereby further powering the cutter mechanism 35 to perforate the web 84, 88.

An over-center spring 381 and related components comprise the most preferred form of biasing means 379 for use with the invention. Preferably, spring 381 is a tension spring and the spring has one end 383 secured to an anchor 385 and a second end 387 secured with respect to the wheel 325 by mounting to articulated arm 388 rotatably mounted to wheel 325. Mounting of arm 388 for rotatable motion minimizes wear on spring 381 and arm 388. The preferred spring 381 is loaded and unloaded as the wheel 325 rotates as described more fully below.

Other biasing means, such as an eccentrically-loaded weight (not shown) could be used as the biasing means 379. It should be noted that biasing means 379, while highly desirable is not necessarily required provided that the stop member is able to return to the ready position without biasing means. Biasing means 379 is not necessarily required to power rotation of drive roller 125. Movement of tension roller 127 downward toward discharge opening 58 will result in more contact between web 84, 88 and drive roller 125 imparting more force to drive roller 125 and decreasing the need for an over center spring 381.

Transfer means 37 is provided to transfer secondary web 88 into the feeding means 33 once the primary web roll 83 is depleted to a predetermined extent. FIGS. 2–12 show an exemplary transfer mechanism 37 for accomplishing this purpose.

The preferred transfer mechanism 37 includes a one-piece transfer arm 389 mounted for movement on frame sidewall outer surface 49 between a "ready" position (FIG. 8) and a "transfer" position (FIGS. 7, 9A–D and 10). As shown best in FIG. 5, the preferred transfer arm 389 comprises first and second ends 391, 393 and inner and outer surfaces 395, 397. As shown particularly in FIGS. 5 and 6, exemplary transfer arm 389 has an upper section 403 including first end 391 and a lower section 405 including second end 393. Preferably, upper 403 and lower 405 sections meet to form an obtuse angle. A preferred angle is approximately 140°.

Transfer arm 389 is preferably mounted for pivotal movement at a single transfer arm pivot axis. Specifically, transfer arm 389 is provided with pivot arm 409 along transfer arm inner surface 395. Pivot arm 409 projects toward frame 13. Pivot arm 409 is positioned in pivot opening 410 provided in frame sidewall 51 and is held in place by any suitable structure, such as retainer 414 engaged to frame wall 45 inner surface 53. Transfer arm 389 is mounted along frame wall 51 outer surface 55. It is envisioned that the transfer arm 389 could be mounted for movement in other manners, such as by linear movement along tracks (not shown) provided on frame 13.

A means 399 for urging the secondary web 88 into nip 269 is preferably positioned along transfer arm first end 391 and means 401 for sensing depletion of primary web roll 83 is positioned along the transfer arm second end 393. The preferred urging means 399 comprises transfer arm 389 and transfer roller arm 413 and first and second transfer rollers 415 and 417. Transfer roller arm 413 is provided with pivot mount 419 configured to be inserted into opening 421 in transfer arm first end 391. Retainer 423, positioned against transfer arm outer side 397, holds transfer roller arm 413 in place for pivotal movement.

First and second transfer rollers 415 and 417 are rotatably secured with respect to transfer arm 389. Specifically, transfer roller arm 413 is provided with roller mounts 425, 427 configured to project toward drive roller 125. Transfer rollers 415, 417 include annular outer surfaces 429, 431 and annular inner surface 433, 435. Roller mounts 425, 427 are sized to receive annular inner surfaces 433, 435 so that transfer rollers 415, 417 are freely rotatable. Transfer rollers 415, 417 are retained on mounts 425, 427 by suitable retainers 437, 439.

First transfer roller 415 is mounted on transfer roller arm 413 so that it extends partially along the axial length of tension roller 127 and in position to engage web 88 along a limited portion of the web 88 width near the edge thereof, thereby urging web 88 against tension roller 127 when transfer arm 389 is in the transfer position. Second transfer roller 417 is also mounted on transfer roller arm 413 so that it extends partially along the axial length of drive roller 125 and in position to engage web 88 along a limited portion of the web 88 width near the edge thereof. Transfer roller 417 urges such web 88 portion against drive roller 125 when transfer arm 389 is in the transfer position. A preferred transfer roller axial length is about 15 mm. As will be described in more detail below, this advantageous arrangement permits reliable transfer of the secondary web 88 to the nip 269 yet requires minimal structure and few moving parts. The smooth surfaces of transfer roller outer surfaces 429, 431 minimize wear on the web material 88 reducing the likelihood that the web material could be torn.

Preferably, transfer arm 389 is biased toward the transfer position by a biasing means such as torsion spring 443. As shown best in FIGS. 4–6, 8 and 10, torsion spring loop 445 is god positioned on pivot arm 409. First spring arm 447 is positioned in slot 449 provided in frame sidewall 45 and spring second arm 451 is positioned over a stop 453 along transfer arm inner surface 395. This preferred apparatus biases transfer arm first end 391 in the direction of arrow 390 in FIG. 8.

The preferred sensing means 401 comprises a sensing member 455 secured with respect to transfer arm 389 in position to contact and ride along outer surface 457 of primary web roll 83 and to hold transfer arm first end 391, transfer roller arm 413 and rollers 415, 417 away from the transfer position until the diminishing diameter of the primary web roll 83 allows transfer arm first end 391, transfer roller arm 413 and rollers 415, 417 to move into the transfer position.

More specifically, exemplary sensing member 455 is provided along arm second end 393 and is configured to project toward frame 13. Sensing member 455 is positioned through arcuate slot 459 provided in sidewall 51. Slot walls 461, 463 limit movement of sensing member 455 and, therefore, limit pivoting movement of transfer arm 389. Sensing member 455 includes at least one sensing surface 462 which rides against the outer surface 457 of primary web roll 83. The positive contact between sensing member 455 and outer surface 457 provides a more accurate measurement of the amount of primary web roll 83 material remaining and avoids premature transfer of the secondary web roll material 87.

The transfer mechanism components may be made of any suitable material. Molded plastic is a particularly useful material because of its durability and ease of manufacture.

Operation of the exemplary dispenser 10 will now be described particularly with respect to FIGS. 7–15. Initially, the dispenser 10 is placed into the "ready position" shown in FIGS. 8 and 14A. Primary web roll 83 is first mounted on support arms 95, 97 with cups 99, 101 positioned in the hollow ends of the primary roll core 85. If a secondary web roll 87 is to be used, that roll is mounted on yoke arms 117, 119 with cups 121, 123 positioned in the hollow ends of the secondary roll core 89.

As shown best in FIG. 8, primary web 84 is positioned over tension roller 127 for threading into nip 269. To facilitate threading of the web 84 into nip 269, drive roller 125 may be manually rotated in the direction of arrow 349 (i.e. counterclockwise in the example shown) by means of hand wheel 211. As the drive roller 125 is rotated, friction surfaces 199–205 engage primary web 84 which is urged against such friction surfaces by tension roller 127 and, potentially, by the action of pulling web 84 by a user. Primary web 84 is drawn through nip 269 as the drive roller 125 rotates in the direction of arrow 349 and tension roller 127 rotates in the opposite direction.

After exiting nip 269 toward arrow 349 (i.e. counter clockwise), primary web 84 is next guided toward discharge opening 58 by arcuate guide wall 63. Drum guard 59 teeth 321 coacting with corresponding annular drive roller grooves 323 separate any web material 84 which may adhere to the drive roller 125 and directs the web material 84 out of the dispenser 10 through discharge opening 58. Primary web material tail 467 is then extended from discharge opening 58 by rotation of hand wheel 211 to an appropriate length for gripping by a user. Rotation of drive roller 125 in the direction of arrow 349 is possible because teeth 347 on wheel 325 are configured so that wheel stop finger 345 can ride over them when wheel 325 rotates in the direction of arrow 349. The primary web material 84 is now positioned for dispensing from dispenser 10.

Secondary web 88 is positioned for dispensing by placing secondary web 88 between (1) tension roller 127 and drive roller 125 and (2) spaced-apart transfer rollers 415, 417. Transfer rollers 415, 417 are spaced apart from tension 127 and drive 125 rollers because engagement of sensing member 455 with primary web roll 83 outer surface 457 prevents spring 443 from urging transfer arm first end 391 and transfer rollers 415, 417 toward tension 127 and drive rollers 125.

Secondary web 88 can simply be draped over primary web 84 wound over tension roller 127 or can be clamped between transfer roller 417 and cover 17 as shown in FIG. 8. It should be noted that the secondary web 88 is not drawn into nip 269 by movement of primary web 84 because any paper-on-paper contact between these webs provides insufficient force to rotate secondary web roll 87 mounted on yoke 111. The transfer mechanism is now in the ready position.

The ready position at the beginning of a dispensing cycle for the preferred stop mechanism 39 and cutting mechanism 35 is shown in FIG. 14A. In the ready position, stop member 353 is preferably positioned wholly within pocket 355. Finger 345 is engaged with tooth 347 to prevent movement of wheel 325 (and drive roller 125) in the direction of arrow 333. Preferred spring 381 is partially loaded. At the beginning of a dispensing cycle, blade 273 is preferably fully retracted within drive roller 125 also as shown in FIG. 14A. The dispenser 10 is now ready for use.

As the user grasps and pulls primary web tail 467 the action of the web 84 against drive roller 125 outer surface 137 causes drive roller 125 to rotate in the direction of arrow 349. At approximately 90° counterclockwise rotation of drive roller 125 (FIG. 11), cam follower 307 begins to enter the inwardly arcuate portion 312 of cam track 309 causing carrier 271 to begin to pivot and to direct blade 273 toward longitudinal opening 207.

At approximately 180° counterclockwise rotation of drive roller 125 (FIGS. 12, 14B), cam follower is fully within inwardly arcuate portion 312 of cam track 309 causing carrier 271 to pivot fully to extend blade 273 out of drive roller longitudinal opening 207 to perforate web material 88. At this point in the dispensing cycle, stop member 353 has passed post 376 yet remains at least partially within pocket 355. Spring 381 is fully loaded.

At approximately 270° counterclockwise rotation of drive roller 125 (FIGS. 7, 14C), cam follower 307 is back along outwardly arcuate portion 314 of cam track 309 causing carrier 271 to pivot back to retract blade 273 within drive roller 125. Spring 381 powers rotation of drive roller 125 as energy is released. At this point in the dispensing cycle, stop member 353 is extended partially outward in the direction of arrow 371 under the force of gravity and the rotational force of drive roller 125.

At approximately 370° counterclockwise rotation of drive roller 125 (FIG. 14D), cam follower 307 remains along outwardly arcuate portion 314 of cam track 309 causing carrier 271 and blade 273 to remain pivoted away from longitudinal opening 207 with blade 273 retracted within drive roller 125.

At this point in the dispensing cycle, stop member 353 is extended fully outward in the direction of arrow 371 due to the rotational force of drive roller 125. Abutment of shoulder surfaces 373 and 375 prevent stop member 353 from sliding completely out of pocket 355. Contact between stop member 353 and post 376 arrests movement of wheel 325 and linked driver roller 125 causing the perforated web 88 to tear thereby providing a single sheet of web material to the user. This condition represents the preferred stop position. Spring 381 is again partially loaded in the stop position.

Finally, drive roller 125 rotates back approximately 10° in the clockwise direction (FIG. 14A) to the ready position under the influence of spring 381. Wheel stop finger 345 engages tooth 347 to prevent more than about 10° rotation in this second direction. The dispenser 10 is now ready for a new dispensing cycle.

Figure 10:
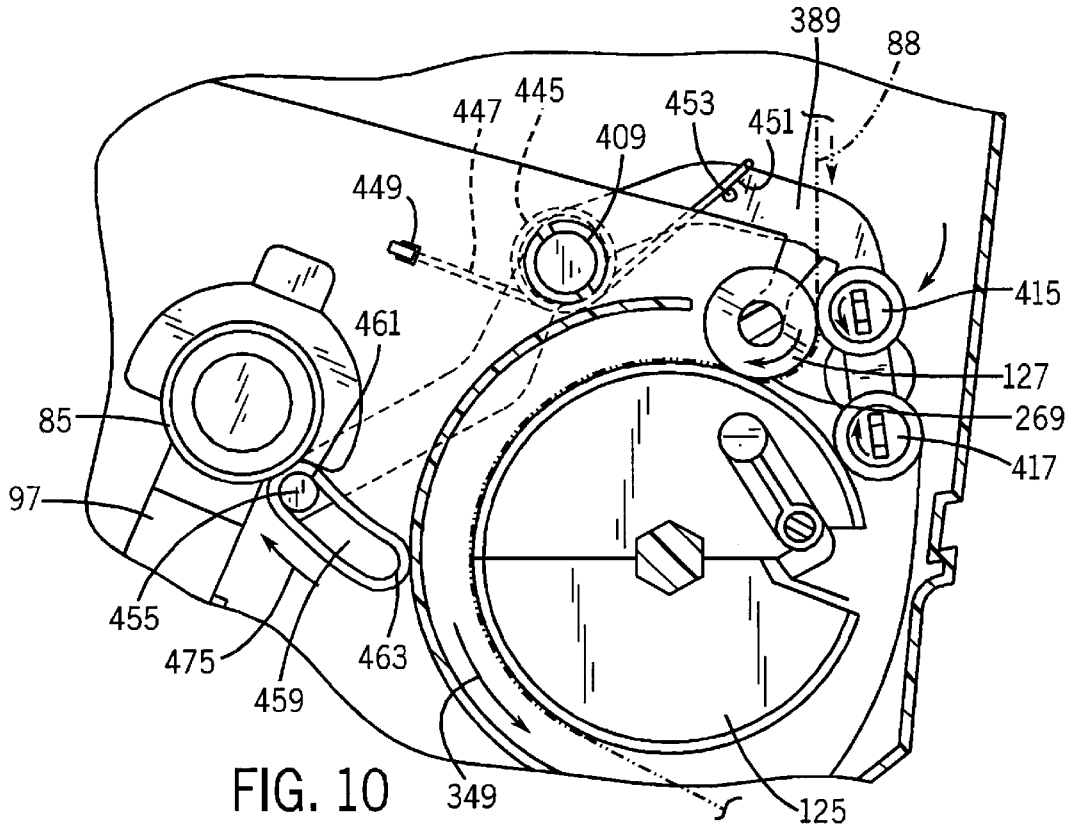
FIG. 10 is an enlarged partial sectional view of the drive roller and transfer mechanism of the dispenser of FIG. 7. The transfer mechanism is positioned in the transfer position.

After many dispensing cycles, primary web roll 83 becomes depleted and the diameter of primary web roll 83 material decreases correspondingly as illustrated in FIGS. 8 and 10. Sensing member 455 contact surface 462 rides along surface 457 causing sensing member to move in the direction of arrow 475. As primary web roll 83 is depleted, spring 443 urges rollers 415, 417 into contact with tension 127 and drive 125 rollers respectively as shown in FIGS. 7, 9 and 10. This position represents the transfer position.

Figure 9A:
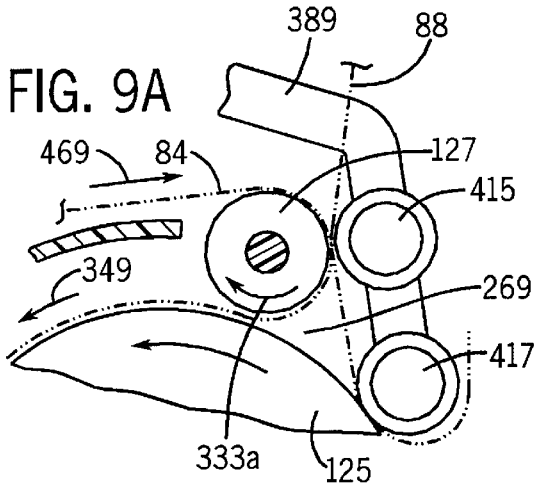
FIGS. 9A–9D are enlarged partial sectional views of the transfer mechanism of FIG. 7 showing the process by which the secondary web material is transferred to the nip for dispensing.

Transfer of the secondary web 88 to the nip 269 when transfer mechanism 37 is in the transfer position is illustrated in FIGS. 9A–D. In FIG. 9A, primary web roll 83 is moving in the direction of arrow 469 and is nearing depletion. Drive roller 125 is rotating in the direction of arrow 349 and tension roller 127 is rotating in the direction of arrow 333*a*. Transfer roller 415 is urged toward tension roller 127 pinching a limited portion of the web 88 width between the drive 125 and tension 127 rollers.

Figure 9B:
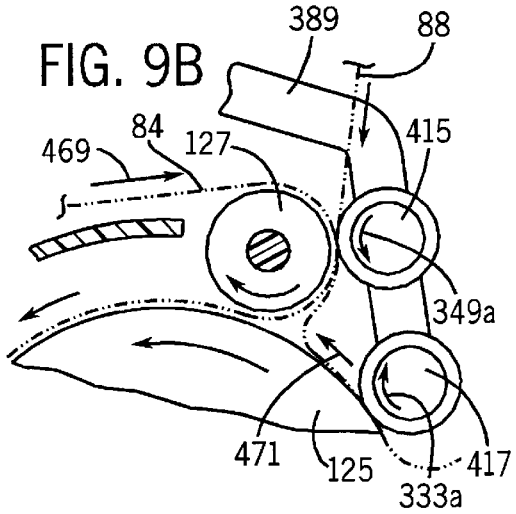

Next, and as shown in FIG. 9B, roller 417 is urged toward drive roller 125 pinching a limited portion of the width of secondary web 88 between the drive 125 and tension 127 rollers. As a result of this contact, roller 415 rotates in the counter clockwise direction as shown by arrow 349*a* and roller 417 rotates in the clockwise direction shown by arrow 333*a*. This counter-rotation action of rollers 415 and 417 causes secondary web 88 to fold toward nip 269 in the direction of arrow 471.

Figure 9C:
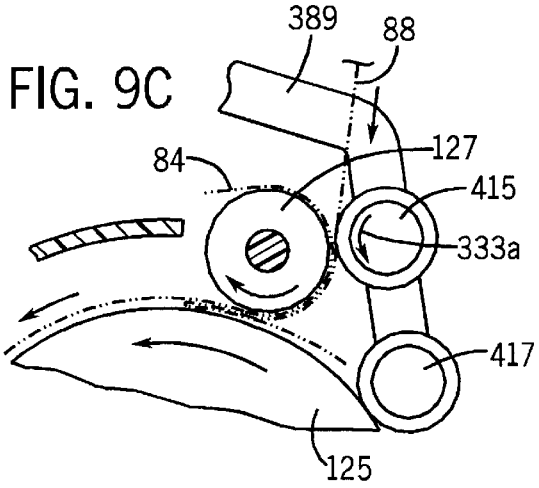

Next, folded secondary web 88 enters nip 269 as shown in FIG. 9C.

Figure 9D:
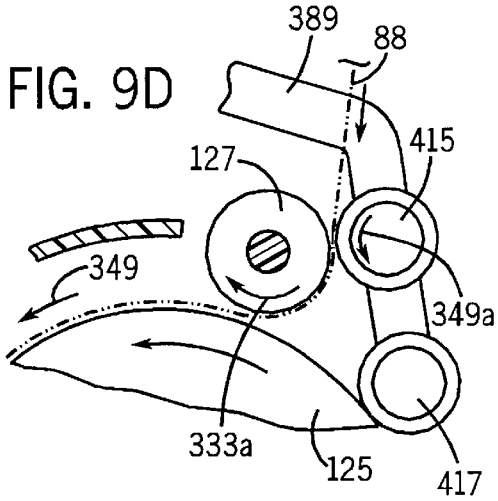

Finally, and as shown in FIG. 9D, all of secondary web 88 is drawn through nip 269 to be dispensed from dispenser completing the paper transfer process. Primary web 84 continues to be drawn through nip and out of the dispenser 10 until that web is fully depleted.

The dispenser may be made of any suitable material or combination of materials as stated above. Selection of the materials will be made based on many factors including, for example, specific purchaser requirements, price, aesthetics, the intended use of the dispenser and the environment in which the dispenser will be used.

While the principles of this invention have been described in connection with specific embodiments, it should be understood clearly that these descriptions are made only by way of example and are not intended to limit the scope of the invention.

We claim:

1. In apparatus for dispensing a web first from a primary roll and, upon depletion thereof, from a secondary roll, the apparatus of the type including a frame, drive and tension rollers which are rotatably mounted to the frame, extend across substantially the width of the web and form a nip therebetween through which the web is fed, and apparatus for sensing the decreasing diameter of the primary roll and transferring the secondary roll web into the nip, the improvement in said sensing/transferring apparatus comprising:

a one-piece transfer arm mounted for movement on the frame between a ready position and a transfer position and biased toward the transfer position;

a first transfer roller rotatably secured with respect to the transfer arm and extending partially across the tension roller in position to engage a limited portion of the width of the secondary roll web and to urge such limited-width portion against the tension roller when the transfer arm is in the transfer position;

a second transfer roller rotatably secured with respect to the transfer arm and extending partially across the drive roller in position to engage the limited-width portion of the secondary roll web and to urge such portion against the drive roller when the transfer arm is in the transfer position; and a sensing member secured with respect to the transfer arm in position to contact the primary roll and to hold the transfer arm away from the transfer position until the diminishing diameter of the primary roll allows the transfer arm to move into the transfer position.

2. The dispenser apparatus of claim 1 further comprising cutter apparatus for cutting the web material into separate sheets of predetermined length.

3. The dispenser apparatus of claim 1 wherein the transfer arm comprises first and second ends and the transfer rollers are mounted along the first end and the sensing member is mounted along the second end.

4. The dispenser apparatus of claim 3 further comprising:

a transfer roller arm movably secured along the transfer arm first end; and the first and second transfer rollers are secured to the transfer roller arm.

5. The dispenser apparatus of claim 3 wherein the transfer arm has an upper section including the first end and a and lower section including the second end and the upper and lower sections meet to form an obtuse angle.

6. The dispenser apparatus of claim 1 wherein the transfer arm is mounted for pivotal movement at a single transfer arm pivot axis.

7. The dispenser apparatus of claim 1 wherein the transfer rollers engage the secondary roll web along only one secondary roll web edge.

8. The dispenser apparatus of claim 1 wherein the transfer rollers have an axial length of about 15 mm.

9. The dispenser apparatus of claim 1 further comprising biasing apparatus for urging the sensing member directly against a primary roll outer surface.

10. The dispenser apparatus of claim 9 wherein the biasing apparatus is a spring.

11. A dispenser for dispensing sheet material comprising:

means for supporting a primary roll of sheet material with respect to the dispenser;

means for supporting a secondary roll of sheet material with respect to the dispenser;

means for feeding sheet material from the dispenser, the feeding means initially feeding the primary roll sheet material from the dispenser; and means for transferring the secondary roll sheet material to the feeding means once the primary roll sheet material is depleted, the means for transferring comprising:

means for sensing depletion of sheet material from the primary roll, the sensing means being positioned directly against an outer surface of the primary roll; and means for urging a limited-width portion of the secondary roll sheet material into the feeding means once the sensing means has detected that the primary roll has been depleted, thereby causing the secondary roll sheet material to be fed from the dispenser by the feeding means.

12. The dispenser apparatus of claim 11 further comprising means for cutting the sheet material into separate sheets of predetermined length.

13. The dispenser apparatus of claim 11 wherein the means for transferring comprises transfer arm means having first and second ends, transfer roller means along the transfer arm means first end and the sensing means is mounted along the transfer arm means second end.

14. The dispenser apparatus of claim 13 wherein the transfer arm means is mounted for pivotal movement at a single transfer arm means pivot axis.

15. The dispenser apparatus of claim 13 wherein the transfer arm means has an upper section including the first end and a and lower section including the second end and the upper and lower sections meet to form an obtuse angle.

16. The dispenser apparatus of claim 11 wherein the transfer roller means engage the secondary roll sheet material along only one secondary roll sheet material edge.

17. The dispenser apparatus of claim 11 wherein the transfer roller means have an axial length of about 15 mm.

18. The dispenser apparatus of claim 11 further comprising biasing means for urging the sensing means directly against the primary roll outer surface.

* * * * *

UNITED STATES PATENT AND TRADEMARK OFFICE

CERTIFICATE OF CORRECTION

PATENT NO. : 6,460,798 B1
DATED : October 8, 2002
INVENTOR(S) : Haen et al.

It is certified that error appears in the above-identified patent and that said Letters Patent is hereby corrected as shown below:

Column 3,
Line 51, before "The", add -- The invention avoids the complex articulated joints of the prior art transfer mechanisms. --;

Column 4,
Line 22, after "transfer", delete ",";

Column 6,
Line 23, delete "19", add -- 119 --;

Column 7,
Line 28, delete ".";

Column 9,
Line 9, delete "tang receiving", and add -- tang-receiving --;
Line 18, after "and", add -- 14 --;
Line 59, after "arrow", add -- 333 --;

Column 11,
Line 65, delete "god".

Signed and Sealed this

Seventeenth Day of June, 2003

JAMES E. ROGAN
*Director of the United States Patent and Trademark Office*